United States Patent [19]

Zoni

[11] Patent Number: 4,716,621

[45] Date of Patent: Jan. 5, 1988

[54] FLOOR AND BOUNDED SURFACE SWEEPER MACHINE

[75] Inventor: Sergio Zoni, Parma, Italy

[73] Assignee: Dulevo S.p.A., Sanguinaro di Fontanellato, Italy

[21] Appl. No.: 886,269

[22] Filed: Jul. 16, 1986

[30] Foreign Application Priority Data

Jul. 26, 1985 [IT] Italy ..... 34889/85[U]

[51] Int. Cl.[4] ..... A47L 11/24

[52] U.S. Cl. ..... 15/349; 15/83; 15/340; 15/352

[58] Field of Search ..... 15/83, 340, 349, 84, 15/79 R, 79 A, 352

[56] References Cited

U.S. PATENT DOCUMENTS

| | | | |
|---|---|---|---|
| 1,087,588 | 2/1914 | Killman | 15/340 X |
| 2,678,462 | 5/1954 | Lison et al. | 15/83 X |
| 2,701,377 | 2/1955 | Luksch et al. | 15/83 X |
| 2,972,159 | 2/1961 | Swanson et al. | 15/83 X |
| 3,918,118 | 11/1975 | vom Berg et al. | 15/83 |
| 4,580,313 | 4/1986 | Blehert | 15/83 X |

FOREIGN PATENT DOCUMENTS

| | | | |
|---|---|---|---|
| 1550446 | 11/1968 | France | 15/340 |

*Primary Examiner*—Chris K. Moore

*Attorney, Agent, or Firm*—Browdy and Neimark

[57] ABSTRACT

The invention relates to a sweeper machine for floors and bounded surfaces, e.g. the floors of workshops and warehouses, courtyards, having engaged with the machine frame, a removable container for collecting the swept trash supported by pivotally-mounted guides engaged by swivel members extending in a crosswise direction to the machine's longitudinal axis and cooperating to define a small frame intervening sealingly between a suction assembly in the frame and a suction mouth of the container, and with snap-action hook-up elements provided between the frame and the pivotally-mounted guides and spring members projecting from the frame and acting by spring contact on the container.

8 Claims, 5 Drawing Figures

FLOOR AND BOUNDED SURFACE SWEEPER MACHINE

BACKGROUND OF THE INVENTION

This invention relates to a floor and bounded surface sweeper machine, in particular of the type usually employed to sweep indoor surfaces clean such as the floor areas of workshops and warehouses, as well as such outdoor surfaces as parking areas, courtyards, and no-traffic areas.

Such sweepers usually comprise, as is known, a wheel-mounted frame supporting at the top steering devices and drive members, and at the bottom a cylindrical brush having its axis parallel to the surface to be swept and at least one substantially upstanding frusto-conical brush.

With the frame there is also engaged a container adapted to collect trash and dirt being swept, and located adjacent the cylindrical brush to which it presents a loading mouth. The container is also usually provided with a suction mouth facing a suction assembly of the machine which cooperates to deliver the swept trash to the container, and which filters out dust.

Whereas large size sweepers, designed for street sweeping, usually have said trash container lifted and shifted by specially provided hydraulic members operated directly from the driver's station, with the sweepers for floors and bounded surfaces, forming the subject matter of this patent, the subject container must be handled manually by an operator.

In particular, the container should be inserted in an empty state and then removed at least each time that it is substantially filled. For insertion it must be lifted by hand and then locked accurately and sealingly against a special seating provided below the frame. For removal the container must be taken off without sharp blows or sudden falls from the working level, to avoid spreading dust and trash.

Moreover, it is observed that if the container is located improperly on the machine, there may occur unacceptable spreading over the ground of the trash being conveyed by the cylindrical brush, as well as interference with the operation of the cited suction assembly, in communication with the container through a suction mouth of the latter.

This situation and the fact that the subject container is usually handled by unskilled personnel often wearing hand protecting gloves have in practice dictated in this type machines, heretofore, that said container be located at the forward end or the rear end of the sweeper. Selection of the forward or rear part of the machine depends on the path which the swept products are made to follow.

At these positions the container is in full view and easily accessed to, and hence easier to grip and handle by hand, as well as easier to check with respect to its location accuracy.

The state of the art provides, to enable manual insertion and withdrawal of the container, such first means as for example rigid chest-type guides, for positioning the container, and such second means as for example handles, handgrips, and the like for lifting the container up to the guides.

In any case the operator is required to operate at successive times means for lifting or lowering the container and means of inserting or withdrawing same, level with the working plane. The container locking and releasing operations are thus comparatively inconvenient and time-consuming, despite the cited accessibility to the container.

These drawbacks are of considerable practical moment, given that handling and precision positioning of the container is one of the most important tasks of an operator with this machine type. Positioning the container at the forward or rear ends of these machines not only fails to satisfactorily solve said problems of container handling but also gives rise to a serious drawback: the container interferes with the wheels, thus conditioning their location. Where the container is provided, moreover, it is impossible to provide a single central steering wheel.

SUMMARY OF THE INVENTION

The technical aim underlying this invention is therefore to provide a sweeper machine which can obviate said drawbacks and make the operation of inserting and withdrawing said containers easy to carry out, direct, and accurate, even where the containers are handled by unskilled operators.

Within said technical aim it is an object of the invention to provide a machine wherein said container can be handled in a convenient and accurate manner even when it is inserted at a distance from the forward and rear ends of the machine, so as not to interfere with the wheels.

Another object of the invention is to provide a sweeper machine of simple construction which is easily manufactured at low costs by the pertinent industry.

The outlined technical aim and the objects set forth are substantially achieved by a floor and bounded surface sweeper machine, of a type which comprises at least one supporting frame, rest wheels for said frame, a cylindrical brush having its axis substantially parallel to a surface to be swept and carried on said frame at a position across the longitudinal axis of the machine, and a storage container for swept trash engaged removably with said frame and having a loading mouth adjacent said cylindrical brush, characterized in that it comprises, for engaging said container with said frame, pivotally mounted guides located at a central region of said frame and extending lateral to the longitudinal axis of the machine, swivel members engaging pivotally said guides with said frame and defining a transverse pivot axis to said guides parallel to said longitudinal axis, hook-up elements provided between said frame and said guides, set apart from said swivel members and adapted to hold said guides at a raised position close against said frame, and pusher members projecting from said frame and acting by spring bias on said container in a substantially parallel direction to said guides, on said container being at least for a major part inserted on said guides and the same are at least close to said raised position.

BRIEF DESCRIPTION OF THE DRAWINGS

Further features and advantages will be apparent from the description of a preferred embodiment of the invention, as shown in the accompanying drawings, where.

DESCRIPTION OF THE PREFERRED EMBODIMENT

Figure 1:
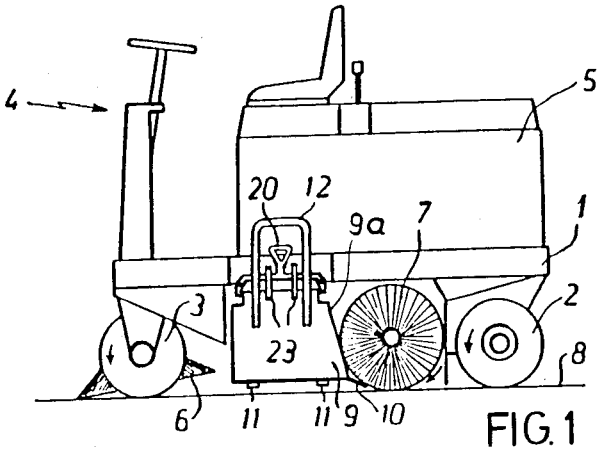
FIG. 1 is a schematical side view of the sweeper machine.

With reference to the cited figures, the sweeper machine comprises a wheel-mounted frame 1: in particular mounted on two rear drive wheels 2 and on a central forward steering wheel 3.

Above the frame 1 there are provided steering devices 4 and control devices 5, known per se. The control devices 5 are housed inside a shroud which extends from the frame 1 and comprise a suction assembly 5*a*.

The frame 1 supports a plurality of rotatable brushes. In particular on the right-hand side forward part of the frame 1, relatively to an operator at the driver's station, there is provided a conical brush 6 having its axis set obliquely relatively close to the vertical direction, adjustable in height over the ground and power driven. Below the middle part of the frame 1 there is provided a cylindrical brush 7 lying across the forward travel direction and the machine longitudinal axis and having its axis substantially parallel to the surface 8 to be swept. The cylindrical brush 7 is also adjustable in height and power driven, and is rotated in the opposite direction to the direction of rotation of the wheels.

In practice this brush 7 picks up dirt from the surface 8 and throws it toward a loading mouth 9*a*.

Figure 4:
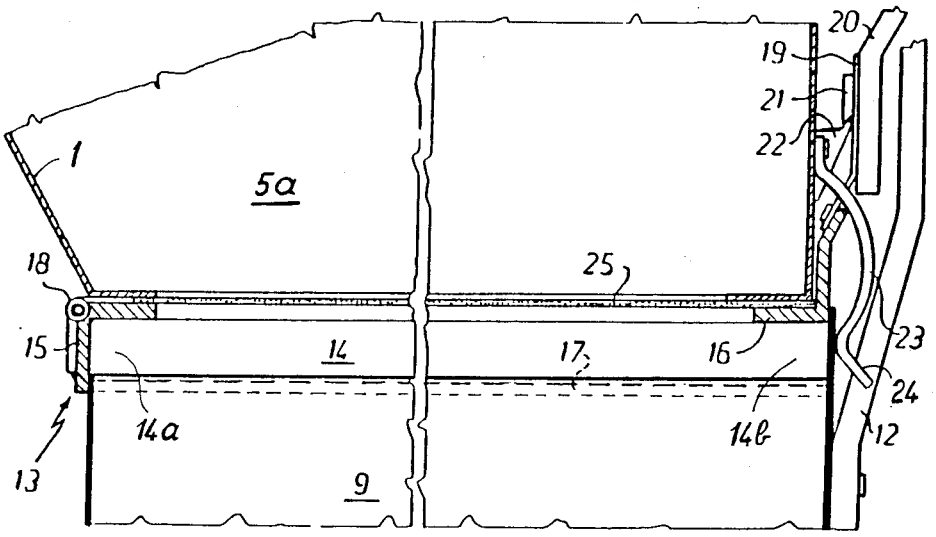
FIGS. 4 and 5 bring out the sections IV—IV and V—V respectively of FIG. 2 and FIG. 3.
Figure 5:
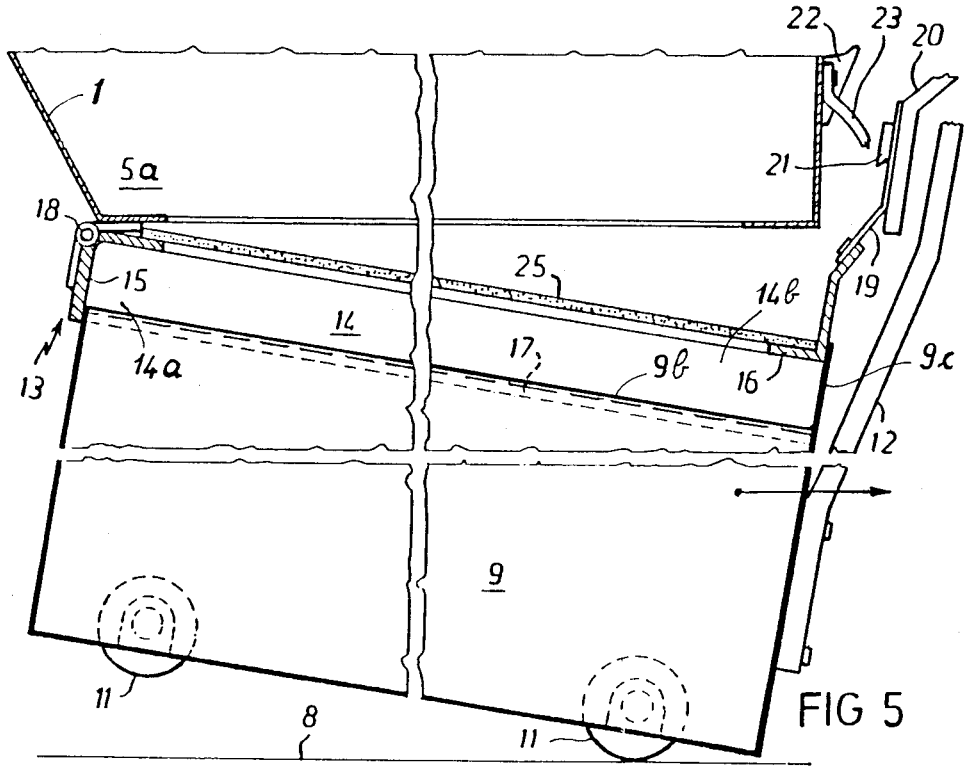

Forwardly of the cylindrical brush 7 there is provided a container or bin 9 for collecting the swept trash which comprises, inter alia, the cited loading mouth 9*a*, a flexible band 10 attached to the bottom edge of the loading mouth 9*a*, and a suction mouth 9*b* provided on the top end of the container 9 itself and being adapted to communicate with a suction and filtering chamber being part of the cited suction assembly 5*a* (FIGS. 4 and 5).

FIG. 5 shows that the container 9 is equipped with four small idler wheels 11 and a big handle 12 for handling and inserting or removing the container 9 into/-from a small supporting frame 13.

On the side engaged with the handle 12, the container 9 has a height extension 9*c* forming a lip along one side of container 9.

The handle 12 is extended above the suction mouth 9*b* and the frame 13 is configured like a picture frame having the shape of the suction mouth 9*b*.

The frame 13 comprises two pivotally mounted guides 14 extending across the direction of forward travel of the machine and being fashioned channel-like with parallel facing grooves. There are closed ends 14*a* and open ends 14*b*, opposite the closed ones, in the guides 14. Through the open ends 14*b*, two brackets, with substantially horizontal extending surfaces 17, projecting from the top of the container 9 are inserted and withdrawn.

The guides 14 are connected by first and second dihedral members 15 and 16 of substantially squared shape. The first member 15 connects between the closed ends 14*a* and the second member 16 connects between the open ends 14*b* and is on the side where the handle 12 is located.

The first member 15 is engaged by swivel members embodied by at least one hinge 18 connected by a swivel member to the frame 1. The hinge 18 defines a pivot axis transverse to the pivotally mounted guides 14 and parallel to the longitudinal axis of the machine, and allows the guides 14 to pivot between a raised position close against the frame 1 (FIG. 4) and a lowered position toward said surface 8. The hinge 18 includes limiting elements adapted to fix the maximum possible pivoting movement of the frame 13.

Furthermore, the first member 15 has its dihedral angle facing downwards and facing inward toward the middle longitudinal portion of the frame 1, thereby its depending side functions as an end closure for the guides 14 and as a stop to the slipping in of the container 9.

The second member 16 is oriented in the opposite direction to member 15 and secured above the guides 14, purposely to permit slipping in and withdrawing the brackets with extending surfaces 17 through the open ends 14*b* of the guides themselves.

The second member 16 abuts on the extension 9*c* of the container 9, when the opposite side of container 9 pushes against the first member 15, and member 16 is engaged with hook-up elements connecting it to the frame 1 and adapted to support the guides 14 in the raised position. These hook-up elements are advantageously embodied, in the embodiment form shown, by a snap-action mechanism.

The upward extending side of the second member 16 is affixed centrally to a resilient blade 19 which has portions bent relative to each other and is provided with a release handle 20 attached to its top portion. On the inside face of the blade 19 there is secured a hook-up element 21 having its active profile facing downwards and conforming with a detent dog 22 connected on the frame 1.

In another embodiment form, the hook-up elements are embodied by a link and a second class lever. The link is swivel mounted at its ends and extends between the second member 16 and an intermediate portion of said lever, whilst the lever itself extends between a pin of engagement with the frame 1 and a free handgrip. The lever is movable toward and away from the frame 1 and when the same is close against the latter said link locates between the frame 1 and said pin.

On the same lateral side of the machine on which said snap-action mechanism is pre-arranged, there engage pusher members embodied by spring members 23 which project from the frame 1 to engage the container 9 by spring bias, forcing same to take an appropriate position when raised.

Figure 2:
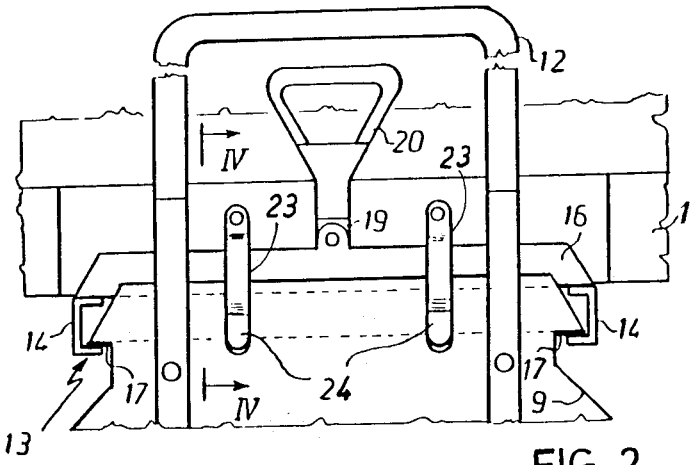
FIG. 2 is a fragmentary view of FIG. 1 which shows, to an enlarged scale, that machine area which is engaged by the collecting container, with the latter in the raised position.
Figure 3:
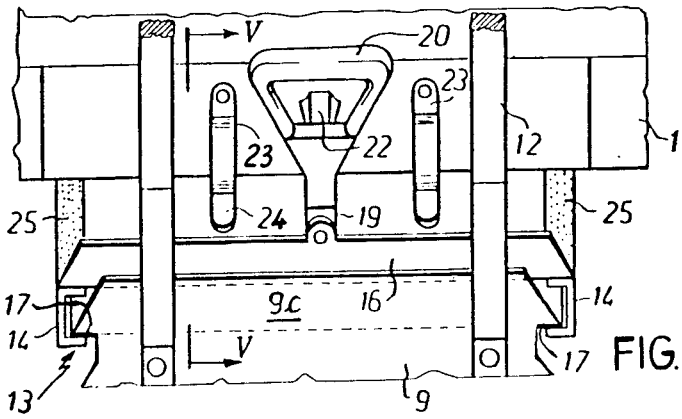
FIG. 3 is a view similar to the previous one but with the container in the lowered position.

The spring members 23 are embodied by leaf springs in the shape of an ordinary stylized "omega" which extend downwards beyond the lower side of the second member 16 with the pivoting small frame 13 raised (FIGS. 2 and 4).

In practice the spring members 23 have a top end attached to the frame 1, and intermediate portion of saddle-like shape extending to contact the container 1, in the working position, level with the small frame 13, and a terminating portion 24 diverging from the frame 13 and the guides 14.

Lastly, it is observed that on the upper peripheral edge of the frame 13 there is provided a gasket 25 adapted to provide a seal with the frame 13 raised. The gasket 25 makes a seal above the frame 13, whilst the seal between the small frame 13 and the container 9 is due to the structure itself of the small frame, that is to say to the shape and position of the guides 14 and members 15 and 16, as already specified.

The invention operates as follows.

To release the small frame 13, it will be sufficient to force the handle 20 away from the frame 1 and deform the blade 19 inwards, thus causing release of the hook-up element 21 from the retaining dog 22. The frame 13 can thus turn downwards to bring a part of the wheels 11 of the container 9 to rest on the surface 8. At this position the spring members 23 are disengaged from the container 9 and the latter can therefore be slid off along the pivotally mounted guides 14, by pulling on the handle 12. Resting of container 9 on the ground occurs gradually and without shocks.

For reverse operation the frame 13 is inserted into the guides 14 which are pivoted downwardly and is then raised, again by means of the handle 12 alone. On completion of the lifting step, the hook-on element 21 and detent dog 22 will engage together automatically. At this position the spring members 23 contact the container 9 and prevent the latter from slipping off.

During the lifting operation, the spring members 23 will push the container 9, by means of their terminating portions 24, into the proper position against the tops of closed ends 14*a* in the guides 14, until this position has been reached.

The invention achieves the important advantage of making the container loading and unloading, simple and direct operations, to be carried out even by unskilled personnel. Neither serious lifting efforts nor special attention to the positioning of the container are required, and insertion and withdrawal can be effected with a single pull or push movement. And this can be accomplished with the container advantageously located away from the wheels.

I claim:

1. A floor and bounded surface sweeper machine, of the type which comprises at least one supporting frame (1), wheels (2,3) supporting said frame (1), a cylindrical brush (7) parallel to a surface (8) to be swept clean and being supported on said frame at a position across the longitudinal axis of the machine, and a storage container (9) for the swept trash engaged releasably with said frame (1) and having a loading mouth (9*a*) adjacent said cylindrical brush (7), characterized in that it comprises, for engaging said container (9) with said frame (1), pivotally mounted guides (14) located in a central portion of said frame (1) and extending in a transverse direction to a longitudinal axis of the machine, swivel members (18) engaging pivotally said guides (14) with said frame (1) and defining a pivot axis connecting and transverse to said guides (14) and parallel to said longitudinal axis, hook-up elements (19–22) provided between said frame (1) and said guides (14) set apart from said swivel members (18) and adapted to hold said guides (14) at a raised position close against said frame (1), and spring members (23) projecting from said frame (1) and acting by spring bias on said container (9) in a substantially parallel direction to said guides (14) when said container has at least a major portion inserted on said guides (14) and said guides (14) are at least close to the raised position.

2. A sweeper machine according to claim 1, further characterized in that said spring members (23) are embodied by at least one spring element secured with one end to said frame (1) and provided with a terminating portion (24) converging toward said guides (14) when said guides (14) are in the raised position.

3. A sweeper machine according to claim 1, further characterized in that said hook-up elements (19–22) are embodied by a snap-actin mechanism comprising a retainer dog (22) attached to said frame (1), a hook-on element (21) engageable with said retainer dog (22), a resilient blade (19) supporting said hook-on element (21) and rigidly attached to said guides (14), and a release handle (20) connected to said resilient blade (19).

4. A sweeper machine according to claim 1, further characterized in that said hook-up elements are embodied by a link engaged with said guides (14) and a second class lever extending between a pin connecting said lever to said frame (1) and a free handgrip, said lever being engaged pivotally at a middle position with said link.

5. A sweeper machine according to claim 1, further characterized in that said guides (14) are two parallel channels having facing grooves for slidingly and oppositely supporting portions of said container (9) and having on one side closed ends (14*a*) and on the opposite side open ends (14*b*), said swivel members (18) defining a pivot axis adjacent said closed ends (14*a*), and said spring members (23) and said hook-up elements (19–22) being adjacent said open ends (14*b*).

6. A sweeper machine according to claim 1, further characterized in that said guides (14) embody opposed parallel portions of a small frame (13) adapted to support said container (9) in a suspended position, said frame 913) comprising in addition to said guides (14) at least one first member (15) and a second member (16) set apart and rigidly connected between said guides (14), said first member (15) being connected with said swivel members (18) and said second member (16) being engaged with said hook-up elements (19–22).

7. A sweeper machine according to claim 6, further characterized in that said small frame (13) comprises sealing gaskets (25) at its upper peripheral edge, said guides (14) fashioned as channels having grooves facing said container (9) and closed in the opposite direction, said first member (15) arranged to close one end of said grooves and said second member (16) overlapping said guides (14) and engageable by abutment on an extension (9*c*) of said container (9) extending in height on that side of container (9) which is remote from the side contacting said first member (15).

8. A sweeper machine according to claim 1, further characterized in that said container (9) comprises brackets having surfaces (17) for insertion slidingly onto said guides (14), a big handle (12) on container (9) for its insertion and withdrawal into and from said guides (14), an extension (9*c*) across said brackets and extending in height adjacently said big handle (12), and ground rest wheels (11) for resting the container (9) onto the ground surface.

* * * * *